US012742300B2

(12) United States Patent
Allen et al.

(10) Patent No.: US 12,742,300 B2
(45) Date of Patent: Sep. 22, 2026

(54) MANHOLE LOCK SYSTEM

(71) Applicant: EJ USA, Inc., East Jordan, MI (US)

(72) Inventors: James R. Allen, Bellaire, MI (US); Collin S. Farmer, East Jordan, MI (US); Kyle Thomas Peters, Charlevoix, MI (US); Scott B. Beal, East Jordan, MI (US); Jeremy I. Johnson, East Jordan, MI (US); Kevin J. Wright, Boyne City, MI (US)

(73) Assignee: EJ USA, Inc., East Jordan, MI (US)

( * ) Notice: Subject to any disclaimer, the term of this patent is extended or adjusted under 35 U.S.C. 154(b) by 893 days.

(21) Appl. No.: 18/076,753

(22) Filed: Dec. 7, 2022

(65) Prior Publication Data

US 2024/0191455 A1 Jun. 13, 2024

(51) Int. Cl.
*E02D 29/14* (2006.01)

(52) U.S. Cl.
CPC ..... *E02D 29/1427* (2013.01)

(58) Field of Classification Search
CPC ..... E02D 29/1427
USPC ..... 404/25; 52/19, 20
See application file for complete search history.

(56) References Cited

U.S. PATENT DOCUMENTS 260,885 A * 7/1882 Castle ..... D05B 3/06 112/77
458,525 A * 8/1891 Farlow ..... B63B 19/00 114/174
681,994 A 9/1901 Steele
1,580,541 A 4/1926 Sherman
1,607,767 A 11/1926 Mcgray
1,614,781 A 1/1927 Conrad
1,693,190 A 11/1928 Louis
1,900,627 A 3/1933 Willoughby
2,114,499 A * 4/1938 Maclear ..... E02D 29/1427 49/465
2,323,886 A 7/1943 Wirz
2,693,100 A 11/1954 Wiegel
3,530,696 A * 9/1970 Dunmire ..... E05B 65/006 404/25
3,550,635 A * 12/1970 Schroer ..... F16L 55/136 215/360
3,744,670 A 7/1973 De Frees
3,848,912 A 11/1974 Nadherny
(Continued)

FOREIGN PATENT DOCUMENTS

WO 2003069075 A1 8/2003
WO 2010123217 A2 10/2010
(Continued)

*Primary Examiner* — Raymond W Addie
(74) *Attorney, Agent, or Firm* — Warner Norcross + Judd LLP

(57) ABSTRACT

A manhole lock system includes a frame positioned over an access opening, a cover movable between a closed position in which the cover extends over the access opening, and an open position in which the access opening is exposed; and a lock mechanism for locking the cover in the closed position. The lock mechanism includes a lock member that is movable along a path between a unlocked position and a locked position, wherein in the locked position the lock member prevents the cover from moving to the open position, wherein in the unlocked position the lock member is retracted to enable movement of the cover to the open position.

19 Claims, 15 Drawing Sheets

(56) References Cited

U.S. PATENT DOCUMENTS 3,994,520 A 11/1976 Oger
4,000,703 A 1/1977 Halliar
4,101,154 A * 7/1978 Kagstrom ..... E02D 29/1427 292/237
4,130,966 A 12/1978 Kujawa et al.
4,203,686 A 5/1980 Bowman
4,365,832 A 12/1982 Treppler
4,514,931 A 5/1985 Beck et al.
4,902,165 A * 2/1990 Embree ..... B65D 90/10 404/72
5,082,392 A * 1/1992 Marchese ..... E02D 29/1427 70/168
5,137,327 A 8/1992 Edmonds et al.
5,231,948 A 8/1993 Malmanger
5,324,135 A * 6/1994 Smith ..... E02D 29/1463 292/149
5,326,188 A 7/1994 Bowman
5,438,935 A 8/1995 Seitz
5,785,362 A 7/1998 Nadherny
5,987,824 A * 11/1999 Fuller ..... E02D 29/14 404/25
6,460,902 B1 10/2002 Kyle
6,739,796 B1 * 5/2004 Del Nero ..... E02D 29/1427 404/25
6,854,922 B1 2/2005 Nicks
7,160,050 B2 1/2007 Meyers
7,484,908 B2 * 2/2009 Stadler ..... E02D 29/1463 404/25
7,501,573 B2 * 3/2009 Balfour, Jr. ..... H02G 9/025 52/33
7,704,010 B2 * 4/2010 Nolle ..... E02D 29/14 404/25
7,744,305 B2 6/2010 Choi
7,748,927 B2 7/2010 Neathery
7,891,904 B2 * 2/2011 Stadler ..... E02D 29/1436 404/25
8,156,773 B1 * 4/2012 Olson ..... E02D 29/1427 70/168
8,206,058 B2 6/2012 Vrondran et al.
8,449,216 B2 5/2013 Vrondran et al.
8,689,488 B2 * 4/2014 Rodrigue ..... E01C 9/083 49/463
8,727,659 B1 * 5/2014 Reynolds ..... E02D 29/14 404/25
9,004,810 B2 4/2015 Reynolds et al.
9,938,686 B2 4/2018 Mitola
10,550,540 B2 2/2020 De Siena
10,704,221 B2 7/2020 Nolle et al.
10,731,396 B2 8/2020 Attee et al.
10,968,595 B2 * 4/2021 Shokouhi ..... E05C 1/12
11,001,982 B2 * 5/2021 Burr ..... E02D 29/1427
11,066,803 B2 7/2021 Dang
2005/0025571 A1 2/2005 Nicks
2005/0175409 A1 * 8/2005 Hauer ..... E05D 11/1014 404/25
2005/0244227 A1 11/2005 Akkala et al.
2007/0081856 A1 4/2007 DeGreef
2008/0141742 A1 6/2008 Stuckey
2010/0281778 A1 11/2010 Loya-Morales
2011/0148631 A1 6/2011 Lanham et al.
2011/0222964 A1 9/2011 LaCroix
2019/0136483 A1 * 5/2019 Nolle ..... E02D 29/1427
2021/0238889 A1 8/2021 Maki

FOREIGN PATENT DOCUMENTS

WO 2016010475 A1 1/2016
WO 2021013314 A1 1/2021
WO 2022013844 A1 1/2022
WO WO-2022150358 A1 * 7/2022 ..... E05B 67/36

* cited by examiner

MANHOLE LOCK SYSTEM

BACKGROUND OF THE INVENTION

The present invention relates to manhole closure assemblies and, more particularly, to a manhole lock system that can be utilized to maintain a manhole cover in a closed position.

Manholes, also known as utility holes or access openings, are both well-known and widely utilized. Manholes are generally utilized as means for providing an access opening for accessing an infrastructure, such as utilities, underground pipelines or cabling. Because manholes are essentially open holes into which an individual can fall, manhole covers, or utility covers, are utilized to prevent entry into the manhole. A traditional manhole cover rests on a frame that is attached to the substructure above the infrastructure to be maintained. The cover rests on the frame and must be lifted and moved, or in some cases pivoted on hinges, in order to gain access to the access opening and the infrastructure beneath the manhole. Typically, manhole covers are formed of iron or other heavy metals and thus can weigh in excess of 100 pounds, creating a cover that is cumbersome to lift and otherwise maneuver. Although it can make manipulation of the cover difficult, the weight of the manhole cover is a benefit in that it helps to prevent the cover from being inadvertently removed from the frame, for example, by the force of passing vehicle traffic. It also helps to deter removal of the cover by unauthorized individuals, and theft of the contents underneath the cover.

It is known to lock or latch a manhole cover to the surrounding frame. In many applications, the lock mechanism is intended to be tamperproof. The frequency with which the lock is used, i.e., locked and unlocked, may be high or low, depending on the circumstances. In many instances though a manhole cover will remain locked for a considerable period.

In an effort to effectuate a locking mechanism, various padlock configurations, keyed locks or other similar locking devices have been utilized. But the use of such locks can be cumbersome and difficult to utilize. They may also fail over long periods of exposure to environmental conditions.

SUMMARY OF THE INVENTION

The present invention provides a manhole lock system that includes a manhole cover with a lock member for a simple and robust method of maintaining the manhole cover in a closed position. The lock member is movable between locked and unlocked positions to selectively hold the cover in place in the closed position.

In one embodiment, the cover has an upper surface, a lower surface and an outer peripheral edge, and the movable lock member is positioned adjacent to the lower surface of the cover, the lock member is movable along a path between a unlocked position and a locked position, the path being angled such that the lock member travels outwardly toward the peripheral edge and also away from the lower surface as the lock member travels along the path from the unlocked position to the locked position. And in one embodiment, the lock member slides along the path from the unlocked position to the locked position under the force of gravity.

The lock member may be connected to the cover by a lock housing, with the lock member slidable within the lock housing. One of the lock member and the lock housing may define a slot, and the other of the lock member and the lock housing may include a post extending into the slot, the post sliding within the slot between the unlocked position and the locked position.

In one embodiment, one of the cover and the lock housing define a release opening. The release opening is aligned with the lock housing to provide access to the lock member through the release opening, although the function of the release opening may not be readily apparent from the exterior of the cover. The lock member may include a catch that can be accessed through the release opening to enable a user to pull the lock member along the path from the locked position to the unlocked position. In one embodiment, the release opening and the housing are shaped to correspond to the shape of a specific removal tool, wherein the removal tool is capable of being inserted through the release opening to engage the catch and pull the lock member to the unlocked position. One of the cover and the lock housing may also define a secondary lock opening, wherein the secondary lock opening may be threaded and can receive a device such as a threaded fastener or a security style fastener that engages the lock member to prevent movement of the lock member.

In one embodiment, the manhole lock system includes a frame, the cover capable of being positioned on the frame over an access opening to cover the access opening, and wherein the lock member engages the frame to prevent removal of the cover from the frame when the lock member is in the locked position, and the lock member is clear of the frame to enable movement of the cover from covering the access opening when the lock member is in the unlocked position.

These and other objects, advantages, and features of the invention will be readily understood and appreciated by reference to the detailed description of the current embodiment and the drawings.

DESCRIPTION OF THE CURRENT EMBODIMENT

Figure 1:
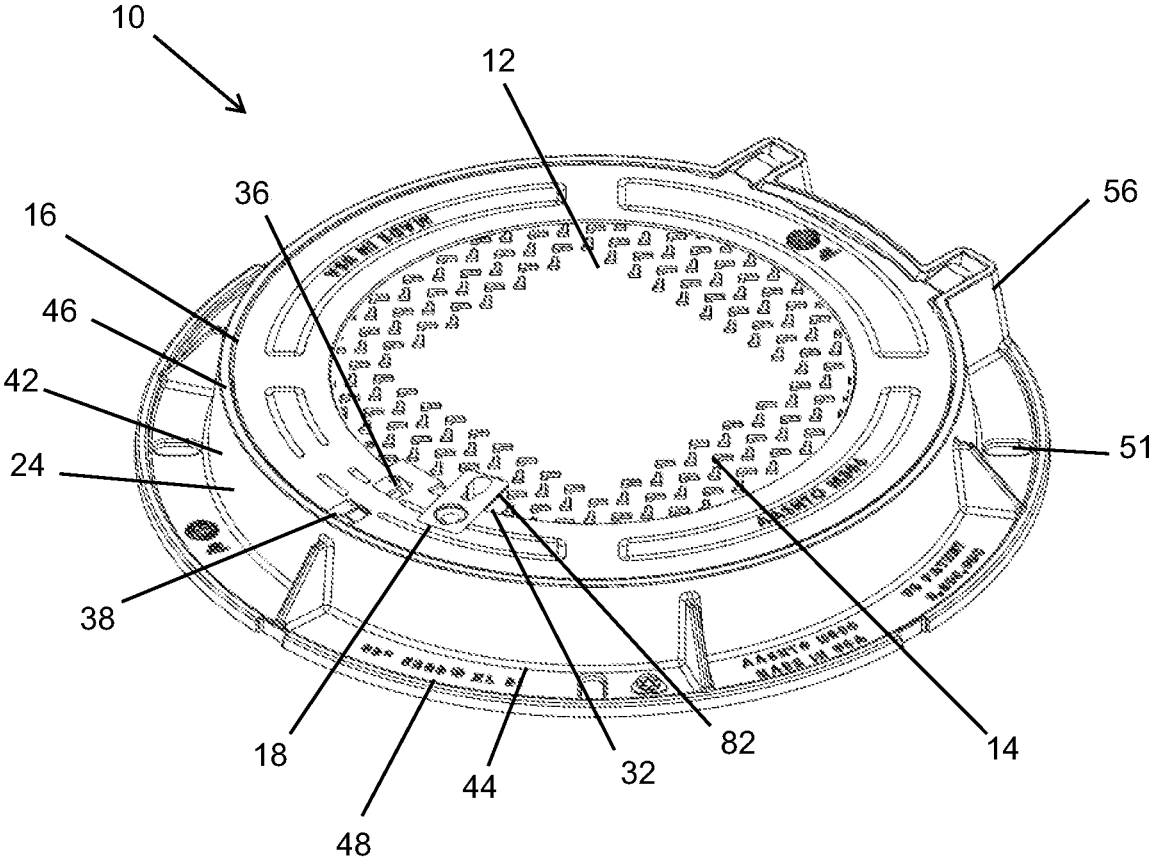
FIG. 1 is a perspective view of a manhole lock system according to one embodiment of the present invention with the cover in a closed position.

A manhole lock system, in accordance with an embodiment of the invention is illustrated in the drawings and generally designated 10.

I. Overview

In the embodiment illustrated in the Figures, the system 10 includes a cover 12, which has a lower surface 13, an upper surface 14, an outer peripheral edge 16. A lock mechanism 18 is positioned on cover 12, and includes a lock member 20 that is movable between a locked position in which the cover 12 is prevented from opening and an unlocked position in which the cover can be opened by a user.

II. Structure

In the illustrated embodiment, the cover 12 is a ductile iron cover. Ductile iron is a cast iron that has been treated while molten with an element such as magnesium or cerium to induce the formation of free graphite as nodules or spherulites, which imparts a measurable degree of ductility to the cast metal. Ductile iron is also known as nodular cast iron, spherulitic graphite cast iron, and spheroidal graphite (SG) iron. In other embodiments the cover 12 can have other shapes and can use different materials known to those of skill in the art. Such materials include, but are not limited to, cast iron, grey iron, polymeric, composite, and fabricated steel or aluminum. In the illustrated embodiment, the cover 12 is made of a single material; however, multiple materials can be used without departing from the spirit of the present invention. Suitable alternative materials and combinations of materials are known to those of skill in the art.

The cover 12 includes an upper surface 14 that can include insignia, designs, demarcations, and/or depressions or channels for funneling excess water off of the cover 12. In one embodiment, the upper surface 14 may include projections and designs that indicate the owner of the cover 10, the manufacturer, the type of infrastructure beneath the manhole or any other pattern. In one embodiment, the cover 12 is generally circular, and includes a generally circular outer peripheral edge 16. In the illustrated embodiment, the cover 12 includes a pair of hinge portions 22 extending from the outer peripheral edge 16 for hingedly connecting to a frame 24 as described in more detail below. Although shown as a circular, hinged cover, the cover 12 may alternatively have a variety of shapes, and may be unconnected from the frame 24 for free removal from the frame 24.

Figure 2:
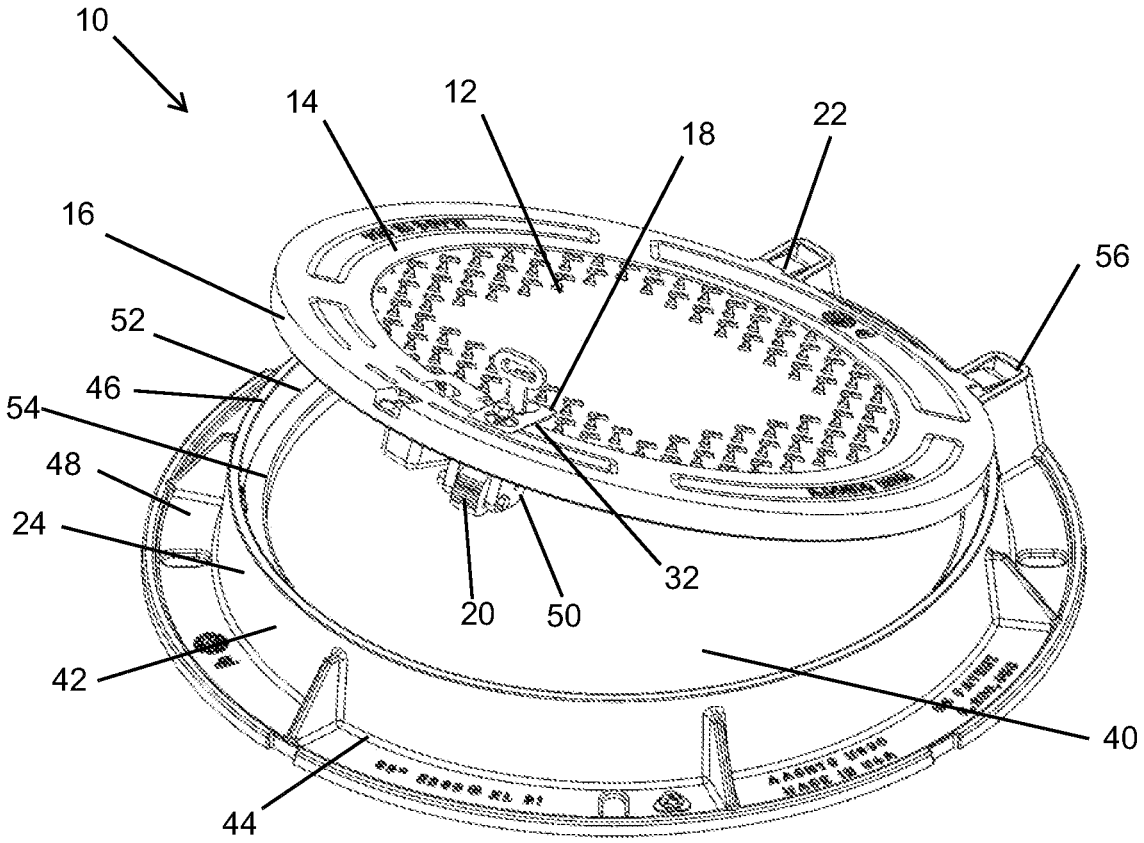
FIG. 2 is a perspective view thereof with the cover in an open position.
Figure 3:
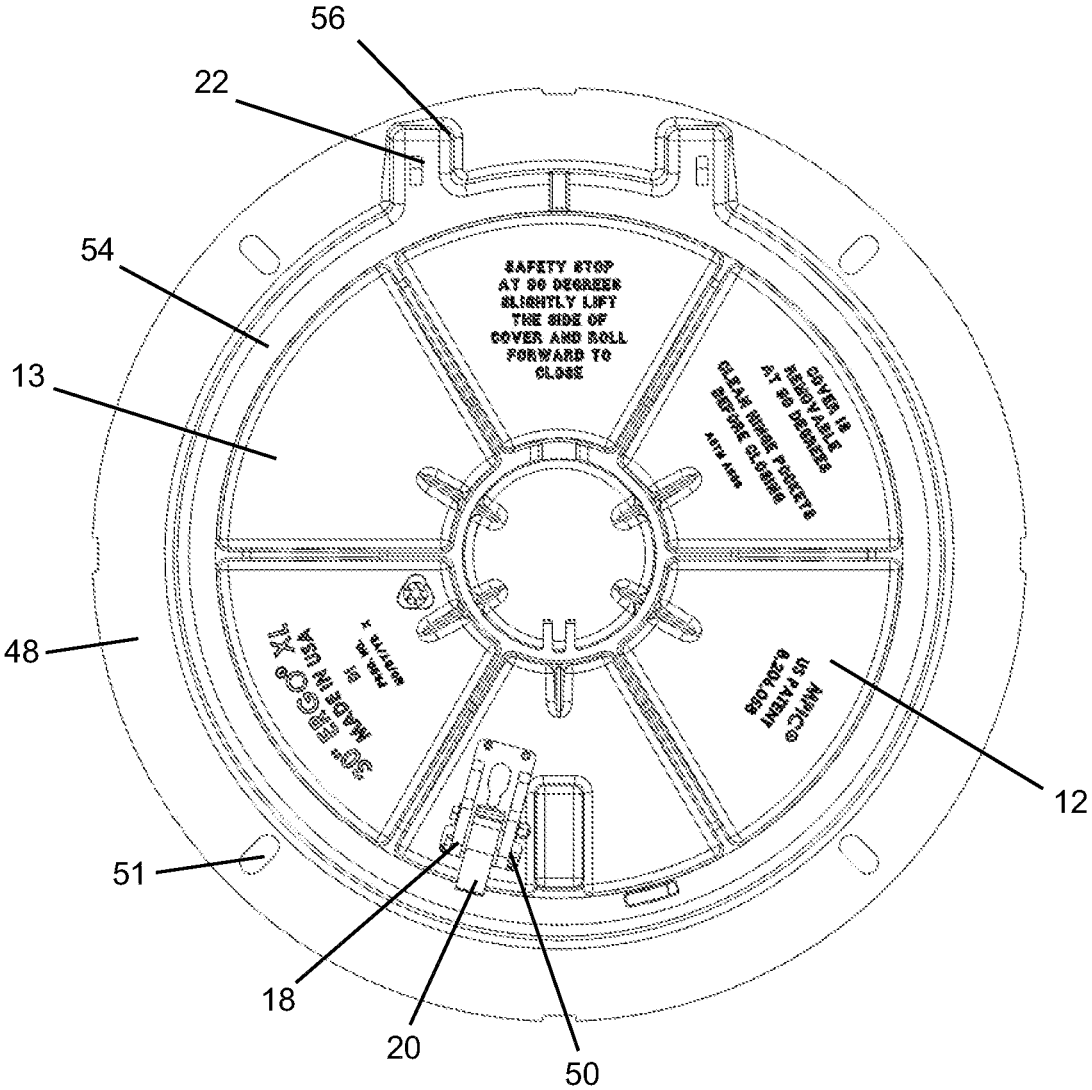
FIG. 3 is a bottom view of a manhole lock system according to the one embodiment.
Figure 13:
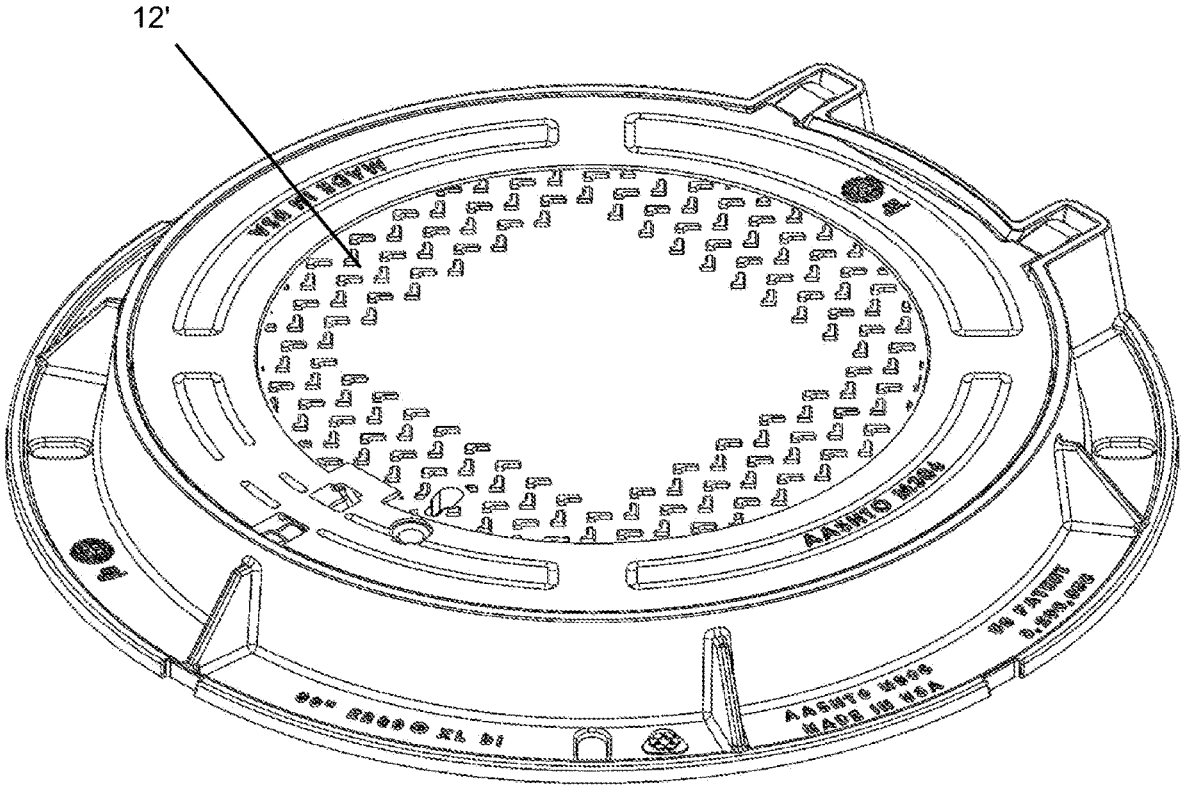
FIG. 13 is a perspective view of a manhole lock system according to an alternative embodiment.
Figure 14:
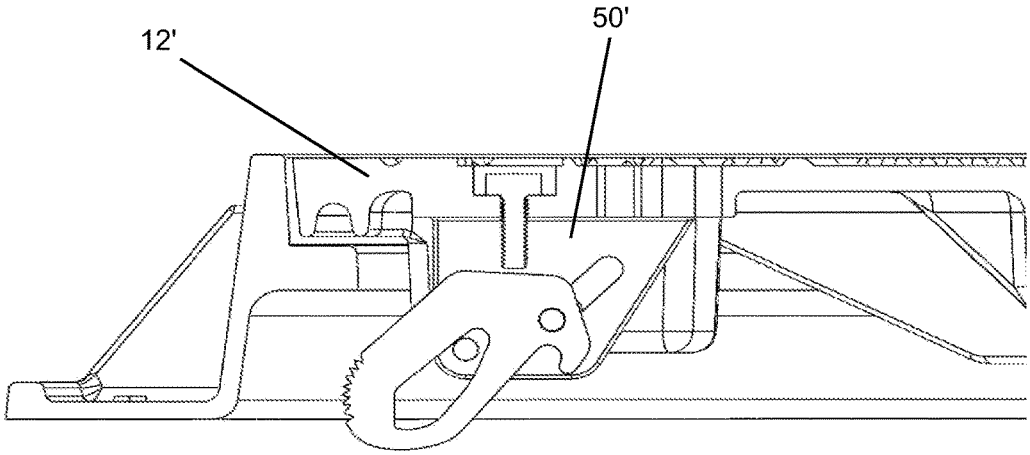
FIG. 14 is a close up cross sectional view thereof.

In the embodiment shown in FIGS. 1-12, the cover 12 defines a lock opening 32 for receiving a lock housing 50. Referring to FIGS. 1 and 2, for example, the lock opening 32 may extend through the cover 12 such that the lock housing 50 can be inserted into the lock opening 32 with an upper wall 82 of the housing 50 generally flush with the upper surface 14 of the cover 12 and the lock member 20 extending through the lock opening and below the lower surface 13 of the cover 12. In another embodiment, the cover 12 may include one or more additional openings for assisting in lifting the cover 12. For example, as shown in FIG. 1, the cover 12 includes a first lift opening 36 and a second lift opening 38. These lift openings 36, 38 may be in fluid communication with each other, and may be designed to receive a pry bar, pick, or other device for assisting a user in lifting the cover 12 to an open position. An alternative embodiment is shown in FIGS. 13 and 14, wherein the lock housing 50' is cast into the cover 12' during the formation of the cover 12', such that the lock housing 50' is unitary with the cover 12' instead of being inserted into a lock opening 32. All other features of the cover 12' are the same as the cover 12 of FIGS. 1-12 and thus not discussed again in detail.

In one embodiment, the frame 24 is shaped to receive the cover 12. In the illustrated embodiment, the frame 24 is formed of grey iron. Grey iron is an iron-carbon alloy (and a form of cast iron) with carbon contents in excess of 2%, generally in the range 2 to 4% with the addition of about 1% silicon. Grey iron is typically different from steel because the carbon present exceeds the solubility limit of 1.7%. This carbon is present in the form of austenite while the excess exists as graphite at room temperature. Consequently, grey irons are sometimes referred to as steels with graphite in them. The structure of grey irons often display three phases, ferrite, pearlite or martensite. Grey iron may be used because of its beneficial properties including, but not limited to, wear resistance, higher electrical resistance compared to steels, and that the corrosion resistance of grey irons is superior to that of carbon steel. In other embodiments, the frame 24 can have other shapes and can use different materials known to those of skill in the art. Such materials include, but are not limited to, cast iron, grey iron, polymeric and composite materials. In the illustrated embodiment, the frame 24 is made of a single material; however, multiple materials can be used without departing from the spirit of the present invention. Suitable alternative materials and combinations of materials are known to those of skill in the art.

Figure 15:
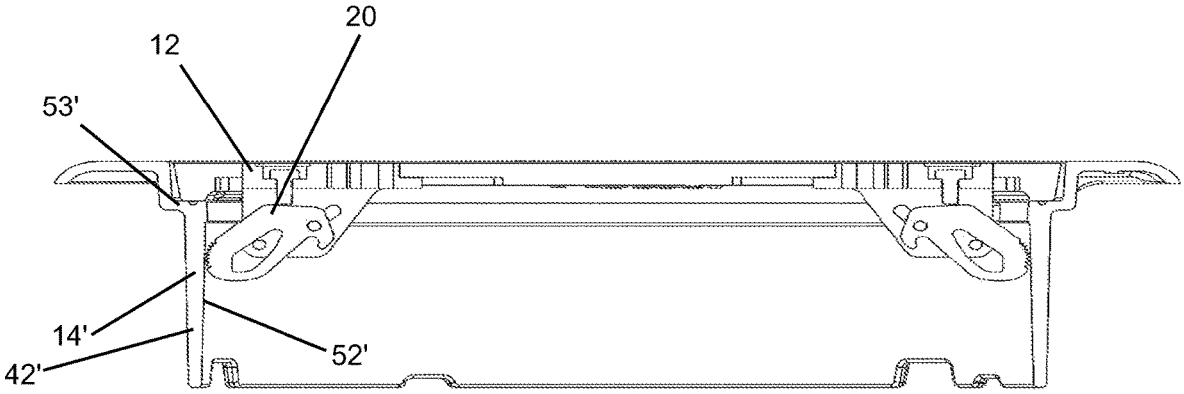
FIG. 15 is a cross sectional view of a manhole lock system according to another embodiment of the frame.

The illustrated frame 24 defines an access opening 40 that may sit atop and define the entrance to a manhole, an underground utility system, a vault, a utility room, or the like. The frame 24 generally includes a sidewall 42 having a base 44 and an upper rim 46. The base 44 forms a ground engaging portion of the frame 24, and may include an outwardly extending mounting flange 48 defining one or more mounting holes 51 for receiving fasteners (not shown) for bolting or otherwise attaching the frame 24 to a ground surface or another surface. In the illustrated embodiment, the sidewall 42 is generally circular, and sized to match the shape of the outer peripheral edge 16 of the cover 12, such that the cover 12 can fit closely within the frame 24 to cover the access opening 40. As shown, the sidewall 42 includes an inner surface 52. And in the embodiment shown in FIGS. 1-12, the inner surface includes an inwardly extending frame seat 54 that is spaced downwardly from the upper rim 46 and forms a seat for the lower surface 13 of the cover 12. In one embodiment, the seat 54 is positioned on the sidewall 42 such that the upper surface 14 of the cover 12 is flush with the upper rim 46 when the cover 12 is seated on the seat 54. In an alternative embodiment, shown in FIG. 15, the frame 14' may have a sidewall 42' that does not include an inwardly extending cover seat. For example, as shown in FIG. 15, the sidewall 42' includes an outwardly extending flange 53' that forms a seat for the cover 12. In such an embodiment, the lock member 20 (as described in more detail below) may engage directly with the inner surface 52' of the sidewall 42' rather than an inwardly extending portion.

Figure 16:
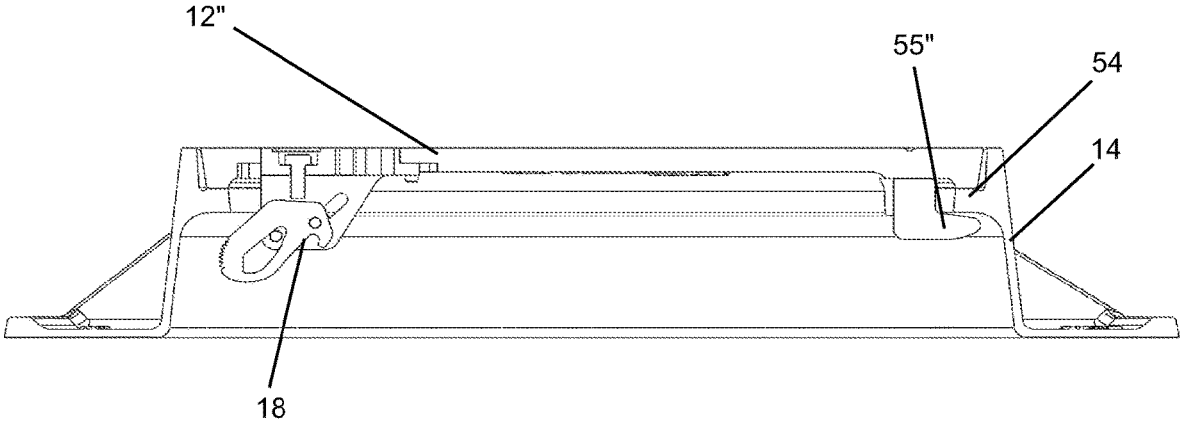
FIG. 16 is a cross sectional view of a manhole lock system according to another embodiment of the cover.

Also in the embodiment of FIGS. 1-12, the frame 24 defines a pair of hinge housings 56 defined by outwardly extending U-shaped sections of the sidewall 42. Each hinge housing 56 includes structure for interfitting with an associated one of the hinge portions 22 of the cover 12. The hinge housings 56 and hinge portions 22 may hingedly connected in a variety of ways. In one embodiment, the hinge housings 56 each include a post (not shown) and the hinge portions 22 a hook (not shown) that fits over the associated post to enable the cover 12 to pivot between the closed position in which the cover 12 is seated on the frame 24 and covering the access opening 40, and an open position (such as that shown in FIG. 2), wherein the cover 12 is at least partially removed from the frame 24 to provide access to the access opening 40. An alternative, non-hinged embodiment is shown in FIG. 16. In this embodiment, the cover 12" includes a hook 55" opposite the lock mechanism 18. The hook 55" functions to retain the cover 12" on the frame 14 by hooking under the frame seat 54 when the cover 12' is positioned on the frame 14.

The lock mechanism 18 is positioned on the cover 12 to provide a structure to hold the cover 12 in the closed position (as shown, for example, in FIG. 1). As noted above, the lock mechanism 18 may be formed with the cover 12, such as being cast with the cover 12 during the casting process, or it may be inserted into a lock opening as shown in FIGS. 1-12, and may alternatively be provided as a standalone lock mechanism unit for covers of a variety of materials, whether formed with the cover or attached to retrofit an existing cover. The lock mechanism 18 requires no modification of the frame 14, such that the lock mechanism 18 can be fitted, or retrofitted, onto a variety of covers for a variety of different frames and frame styles.

In one embodiment, the lock mechanism 18 includes the lock member 20 and the lock housing 50. The lock member 20 is a movable member that includes an interference surface 60, a retention surface 62, a catch 64, and structure for slidably mounting the lock member 20 to the lock housing 50. In one embodiment, the interference surface 60 forms a leading edge of the lock member 20, positioned nearest to the outer peripheral edge 16 of the cover 12. As shown, the interference surface 60 includes a toothed portion 66 nearest to the outer peripheral edge 16 and a flat portion 68 extending from the toothed portion 66 to the retention surface 62. The toothed portion 66 is optional, and may not be included, for example, in an embodiment where it is known that the lock mechanism 18 will be positioned on a cover 12 that will be attached to a frame 14 with a cover seat 54. The retention surface 62 is a flat surface that extends at an angle from the interference surface 60, and in the illustrated embodiment, the retention surface is generally parallel to the cover 12 whereas the interference surface 60 extends at about a 45 degree angle from the retention surface 62. As described in more detail below, the catch 64 is positioned and shaped to be engaged by a removal tool 34 that can pull the lock member 20 to move the lock member 20 and enable movement of the cover 12. As shown, the catch 64 is positioned at a rear edge of the lock member 20 and is generally hook shaped, although other positions and shapes may be used.

As noted, the lock member 20 includes structure for slidably mounting the lock member 20 to the lock housing 50. In one embodiment, this structure includes a lock member slot 70 and a post hole 72. The lock member slot 70 is a generally open slot defined in the lock member 20 and capable of receiving a housing post 74 affixed to the housing 50 as described in more detail below. The post hole 72 is a hole or opening formed in the lock member 20 for receiving a post 94 such that the post 94 extends from and moves with the lock member 20. In one embodiment, the post hole 72 is sized to receive a post 94 in the form of a bolt or other fastener. In another embodiment, as an alternative to a post hole 72, a post 94 may simply be affixed to and extend laterally from the lock member 20.

Figure 9:
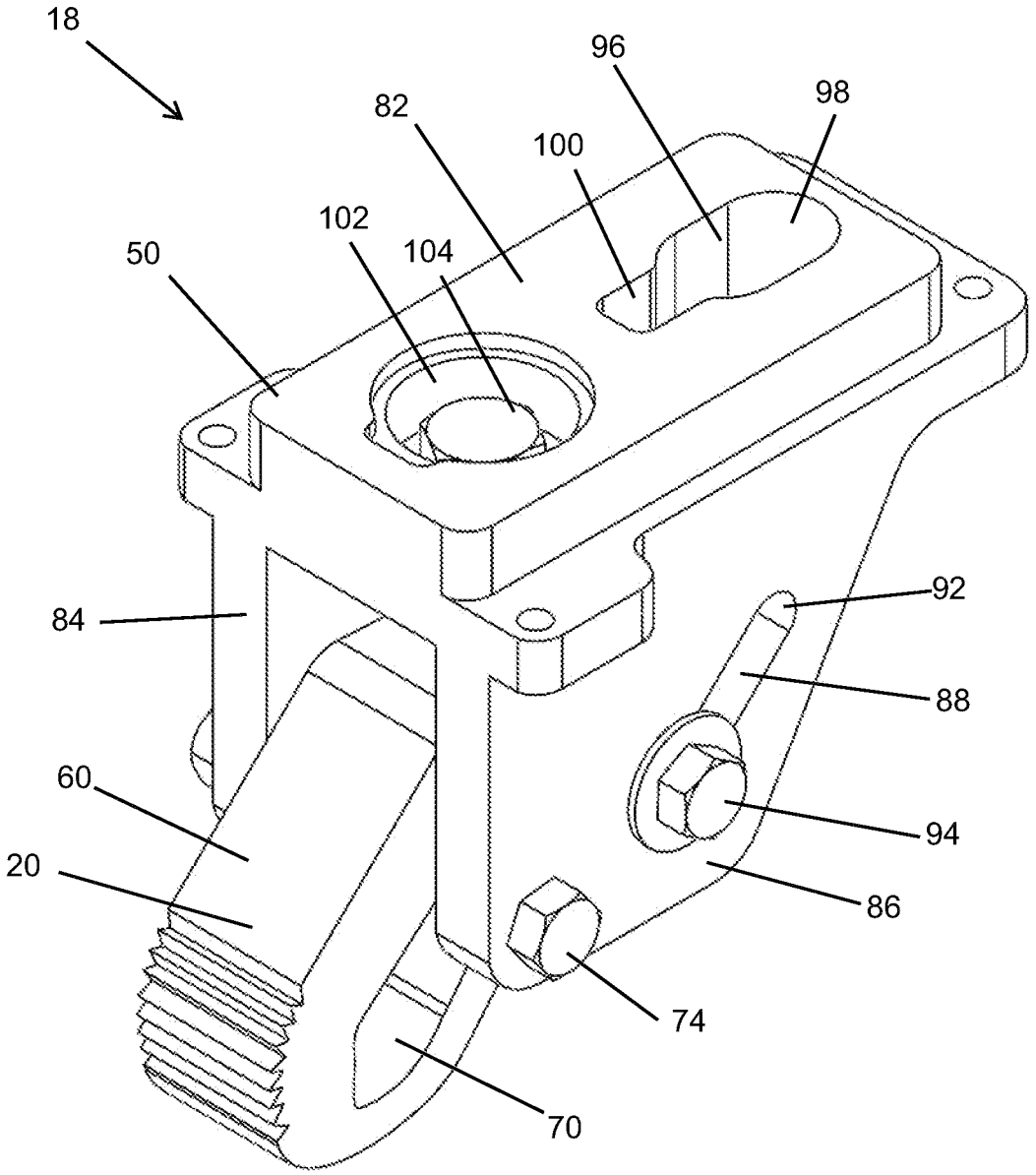
FIG. 9 is a perspective view of a lock mechanism in a locked position according to one embodiment.
Figure 10:
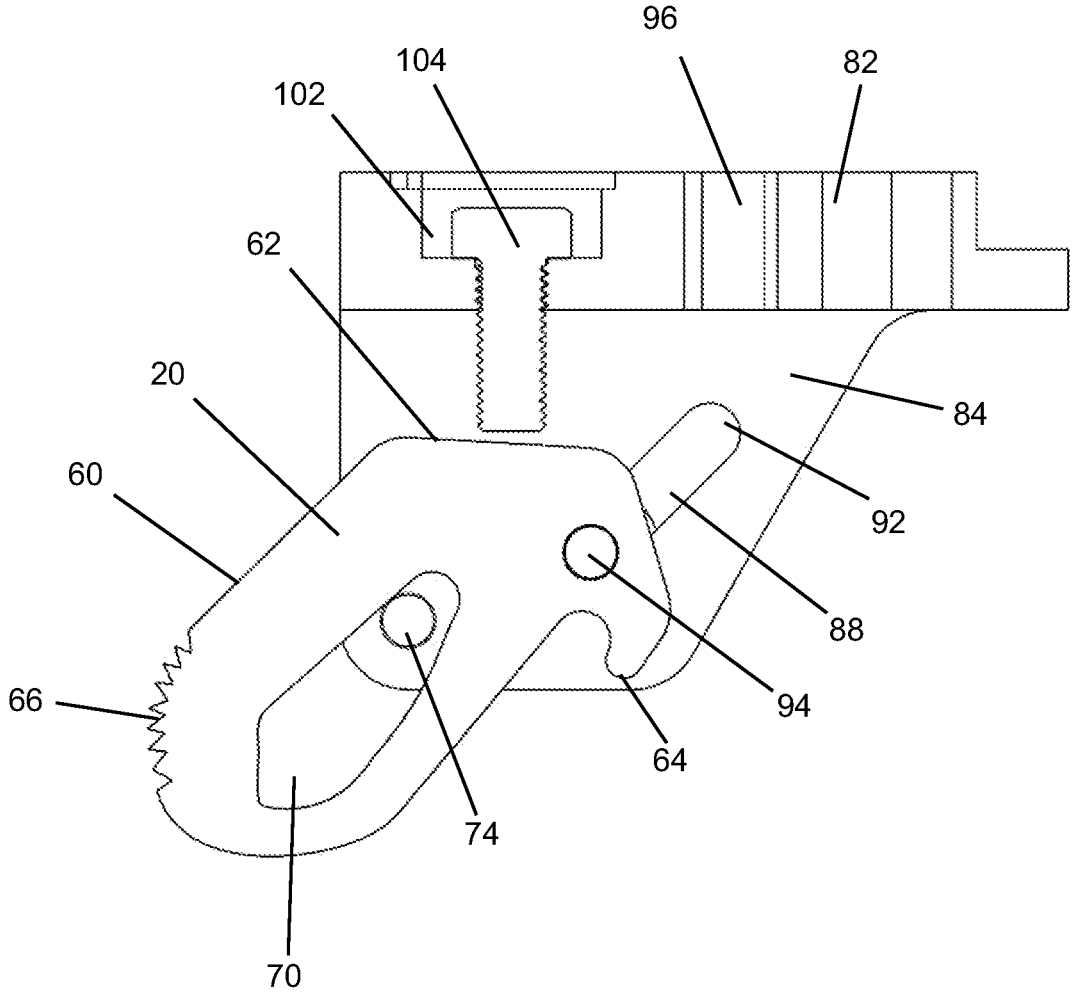
FIG. 10 is a cross sectional view thereof.

In the illustrated embodiment, shown, for example, in FIG. 9, the lock housing 50 includes an upper wall 82 and a pair of spaced apart housing sidewalls 84, 86 extending from the upper wall 82. The lock member 20 is slidably mounted within the housing, between the sidewalls 84, 86. As illustrated, each of the housing sidewalls 84, 86 defines a slot 88 that determines the path of sliding travel for the lock mechanism 18. More particularly the slots 88 each have a first end 90 (see FIG. 11), a second end 92, and a longitudinal extent therebetween. The slots 88 are sized to receive the post 94 extending from and moveable with the lock member 20, wherein the post 94 can travel along the slots 88 by sliding along the slots 88 between a first, or locked, position at the first end 90 and a second, unlocked position at the second end 92. In the illustrated embodiment, this path is angled with respect to the upper wall 82 of the housing 50 and with respect to the cover 12 or frame 24. As shown, the path is angled such that the lock member 20 moves outwardly (i.e., away from the center of the cover 12 and toward the peripheral edge) and downwardly (i.e., away from the lower surface 13 of the cover 12). In this way, the lock member 20 is caused to slide down the slots 88 to the first end 90 as a result of gravity when the cover 12 is near the closed position. In one embodiment, the slots 88 are angled at about 45 degrees from the upper wall 82 of the housing and from the lower surface 13 of the cover 12. In other embodiments or applications (such as an application where the cover 12 is not installed on a flat, horizontal surface), the angle of the slots 88 may be another angle that enable the lock member 20 to slide down the slots 88 and remain in the second position of the slots 88 when the cover 12 is closed, without the need for a spring or another force to hold the lock member 20 in the second position. Notably, although the illustrated embodiment shows the slots 88 positioned on the housing 50, a slot that controls the path of the lock member 20 could alternatively be positioned on the lock housing 50. The slots 88 also provide a "slam latch" function, wherein the cover 12 can be closed without manipulation of the lock member 20 by the user because in the case of interference between the lock member 20 and the frame 14 as the cover is closed, the lock member 20 will simply slide up the slots 88 until there is no further interference and the cover 12 can close. The angle and position of the slots 88 can also make the lock member 20 adaptable to a wide variety of frames, leaving a gap between the lock member 20 and the frame 14 when the lock member 20 is in the locked position, such that the lock member 20 can fit with frames of different shapes and sizes without readjustment of the lock member 20.

Figure 4:
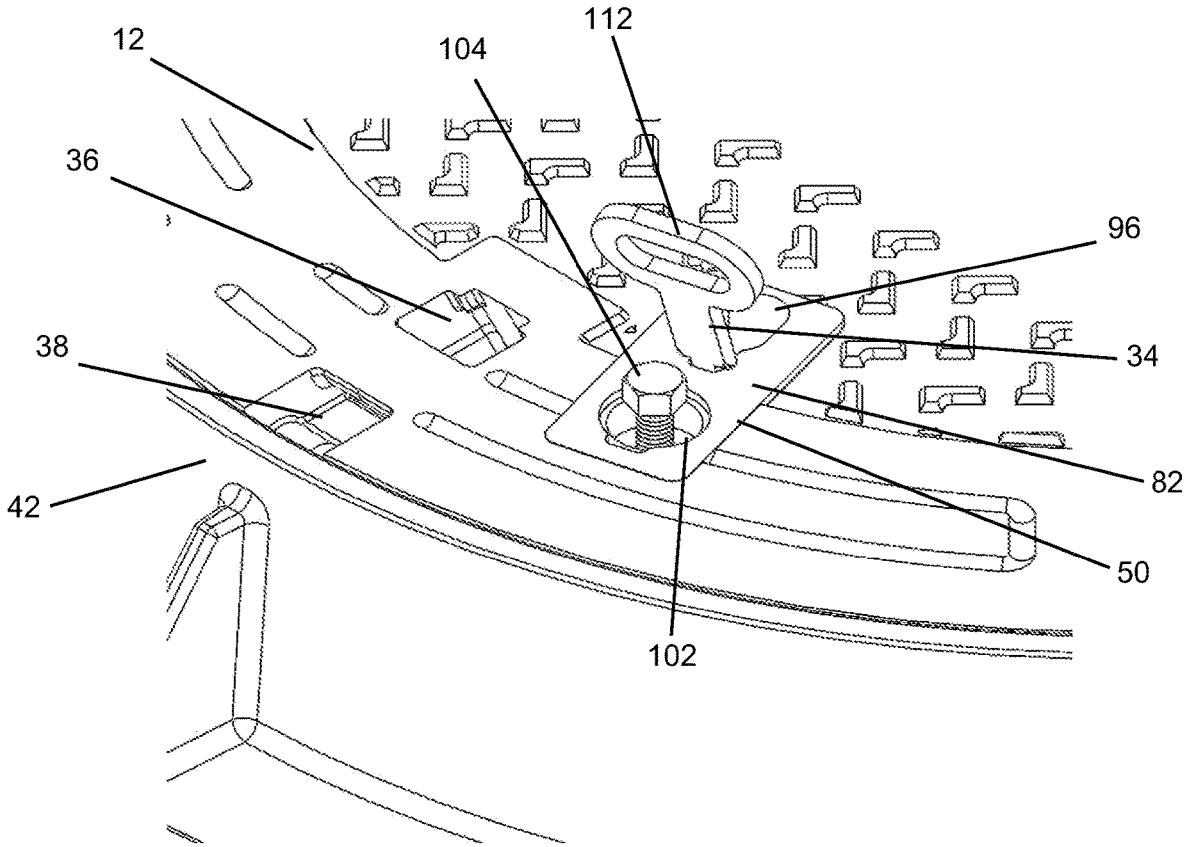
FIG. 4 is a close-up view of a portion of the manhole lock system.
Figure 6:
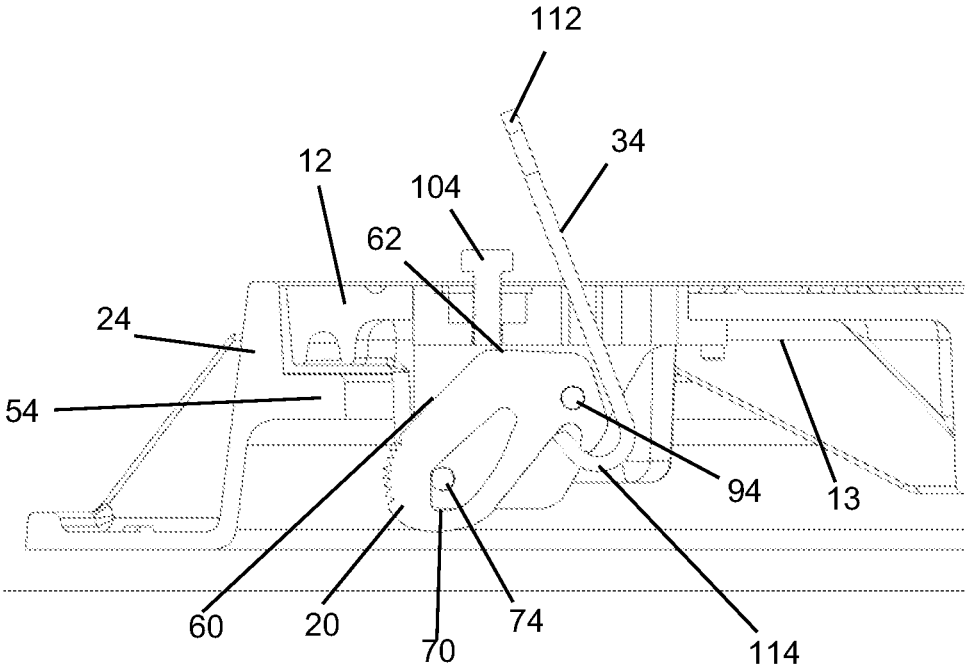
FIG. 6 is a cross sectional view of the one embodiment of the manhole lock system in a closed and unlocked position.
Figure 7:
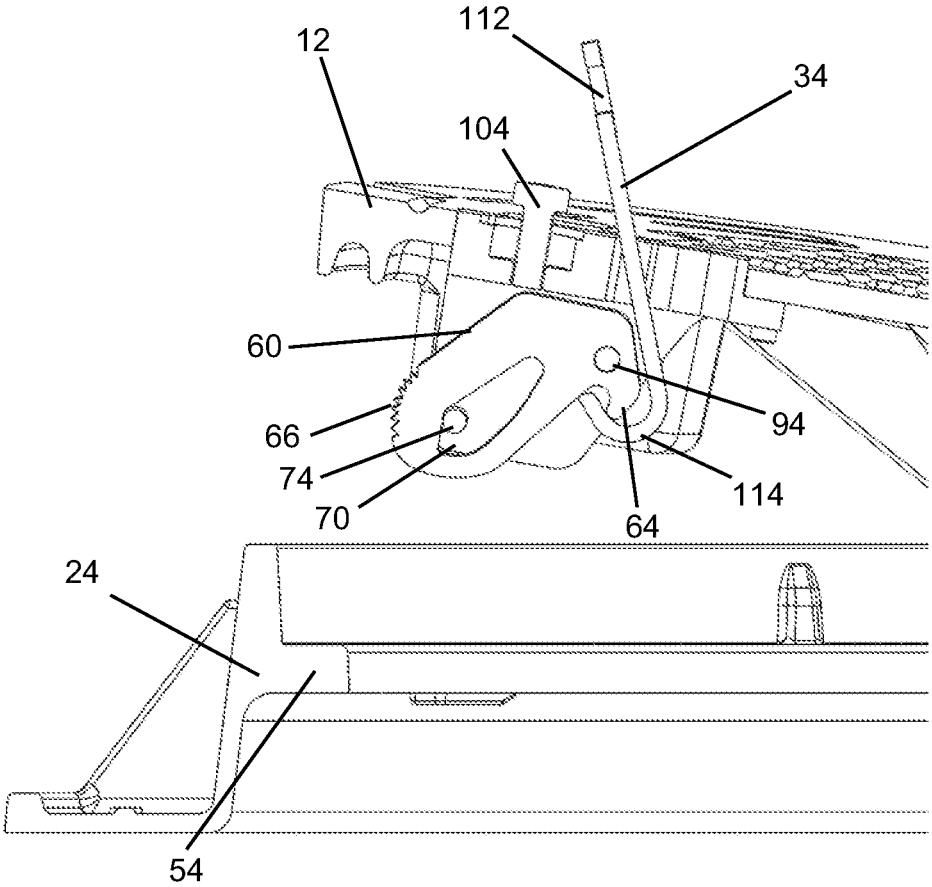
FIG. 7 is a cross sectional view of the one embodiment of the manhole lock system in an open and unlocked position.
Figure 8:
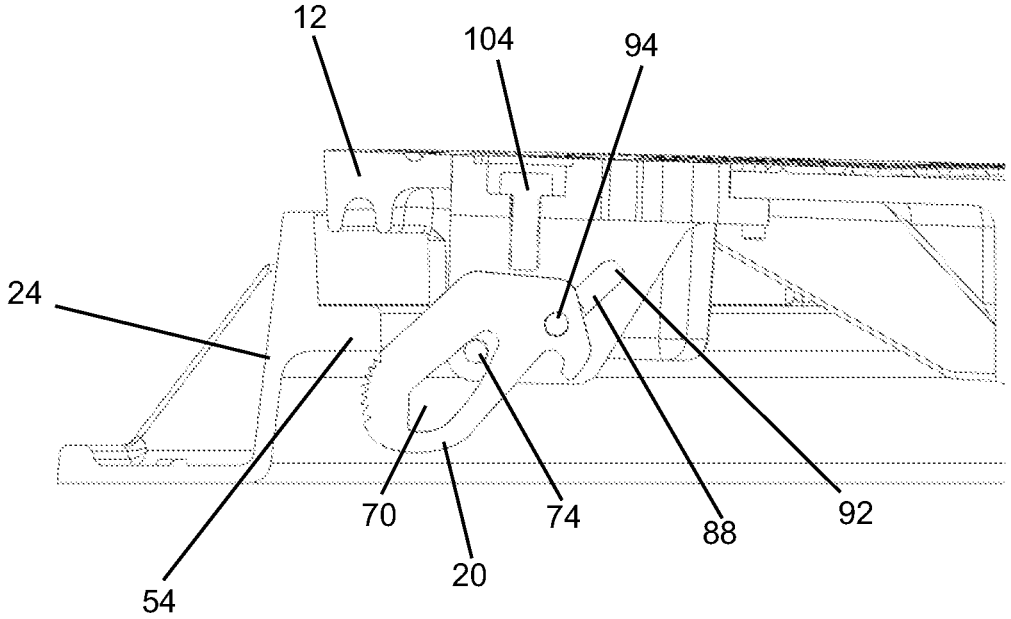
FIG. 8 is a cross sectional view of the one embodiment of the manhole lock system in a substantially closed and locked position.
Figure 11:
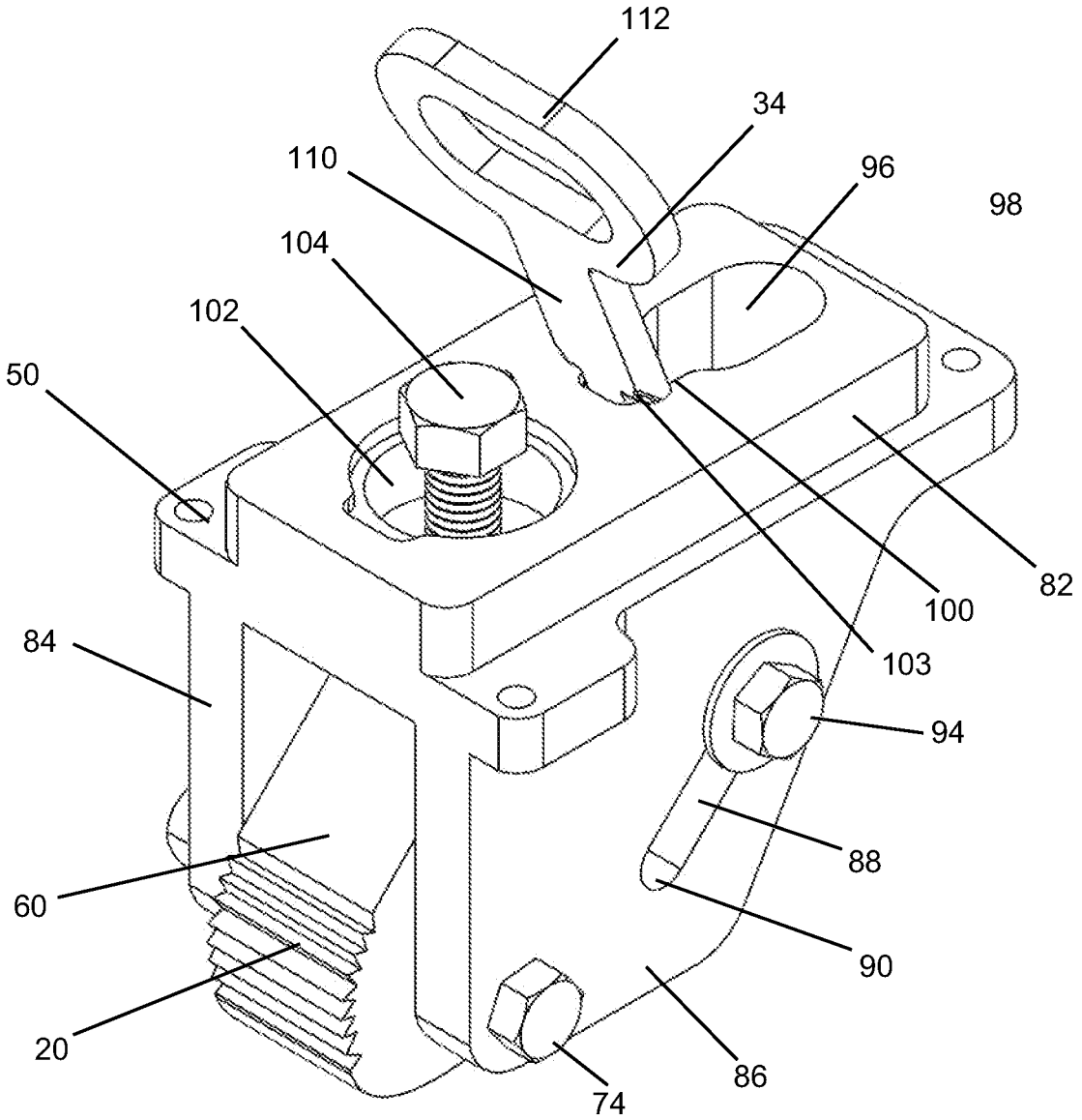
FIG. 11 is a perspective view of the lock mechanism in an unlocked position.
Figure 12:
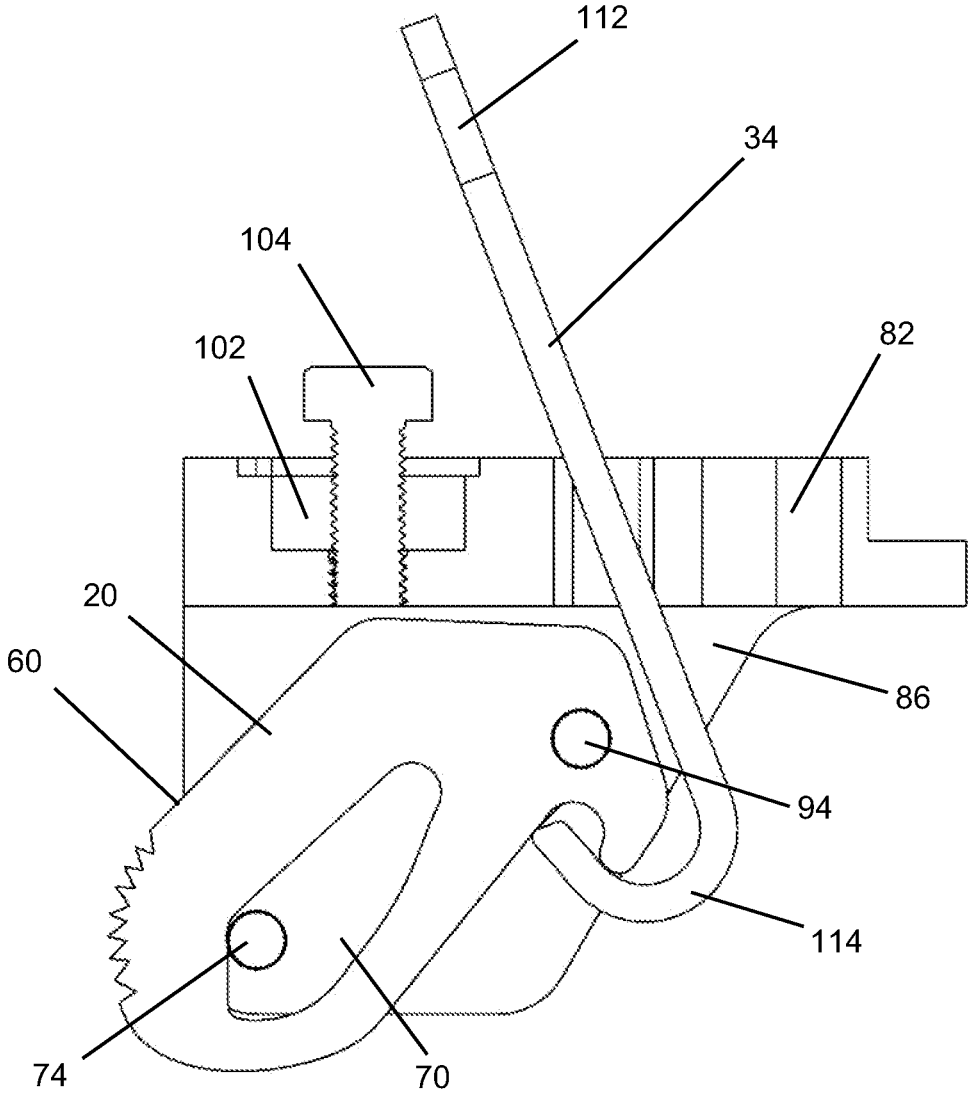
FIG. 12 is a cross sectional view thereof.

The lock housing 50 may additionally include structure for enabling the manual release of the lock member 20, and for securing the lock member 20 in the locked position. In one embodiment, the upper wall 82 of the lock housing defines a release opening 96 extending through the upper wall 82. The release opening 96 extends through the upper wall 82, and as illustrated the release opening 96 has a keyhole shape wherein the release opening 96 has a first, generally wider section 98, and a second, generally narrower section 100. The narrower section 100 may be positioned closer to the outer peripheral edge 16. Referring to FIGS. 4, 6 and 7, the release opening 96 is positioned with respect to the lock member 20 and the lock housing 50 such that the catch 64 is accessible through the release opening 96 by a removal tool 34. The release opening 96 and removal tool 34 may be constructed to correspond to one another, such that the removal tool 34 is shaped and sized to be inserted through the release opening 96, into the lock housing 50, and into engagement with the catch 64 in such a manner that a user can pull on the removal tool 34 to draw the lock member 20 from the locked position to the unlocked position. In the illustrated embodiment of the removal tool 34, it includes a generally straight stem 110, having a handle 112 at one end and a hook 114 at the opposite end. The release opening is sized such that the user can insert the hook 114 through the wider section 98 of the release opening 96 and underneath the catch 64 with the handle 112 extending from the upper surface 14 of the cover 12. Referring to FIG. 11, in one embodiment, the removal tool 34 includes a shoulder 103 on the stem 110, which enables a user to move the stem 110 into the narrower section 100 of the opening 102 when the lock member 20 is released such that the shoulder 103 holds the removal tool 34 in the release position.

In another embodiment, the upper wall 82 includes a secondary lock opening 102 defined in the upper wall 82 generally adjacent to the release opening 96. As illustrated, for example, in FIG. 4, the secondary lock opening 102 is positioned between the release opening 96 and the outer peripheral edge 16. The secondary lock opening 102 is aligned above the lock housing 50, and above the retention surface 62 of the lock member 20 to enable insertion of a device through the secondary lock opening 102 that can engage the retention surface and prevent movement of the lock member 20. The secondary lock opening 102 may be a fastener receptacle, such as a threaded receptacle for receiving a retaining a threaded lock fastener 104. The threaded lock fastener 104 can be threaded into the secondary lock opening 102 to engage, or sit adjacent to, the retention surface 62 to hold the lock member 20 in place in the lock position at the second end 92 of the slot 88. The secondary lock opening 102 and lock fastener 104 provide a secondary or backup means as an additional level of security for locking the cover 12 closed.

Notably, in the illustrated embodiment, the lock housing 50 is positioned in a lock opening 32 in the cover 12, which enables the lock mechanism 18 to but in another embodiment, the upper wall 82 of the lock housing 50 could be formed unitarily with the cover 12, such that the sidewalls 84, 86 of the lock housing 50 extend from the lower surface 13 of the cover 12, and the release opening 96 and lock opening 102 are defined directly in the cover 12, rather than in the lock housing 50.

Figure 5:
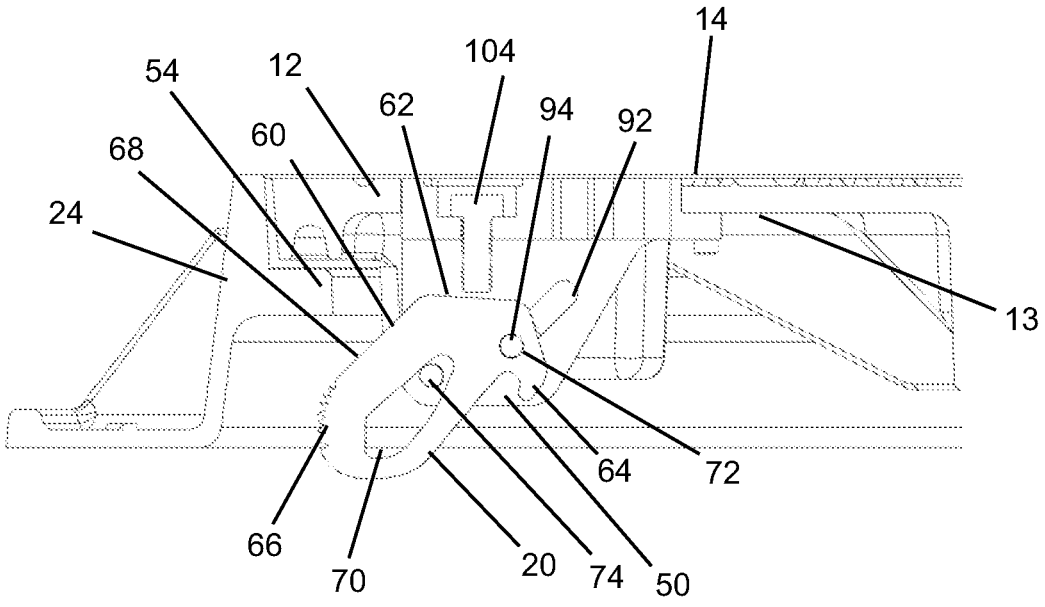
FIG. 5 is a cross sectional view of the one embodiment of the manhole lock system in a closed and locked position.

Referring to FIGS. 5, 6 and 7, the lock mechanism 18 is positioned and arranged on the cover 12 such that the lock member 20 extends under a portion of the frame 24 (or another component) when the lock member 20 is in the locked position, such that the interference surface 60 of the lock member 20 engages the frame 24 upon an attempted opening of the cover 12 and prevents the cover 12 from being moved to an open position. FIG. 5 shows an example of the lock mechanism 18 in the locked position. In this position, the lock member 20 is located in the locked position, with the post 94 positioned at the first end 90 of the slot 88. As noted, the pin 94 and lock member 20 will slide into this position automatically upon movement of the cover 12 to the closed position because the angle of the slot 88 includes a downward direction and the lock member 20 is caused to fall to the locked position. With the lock member 20 in the locked position, the interference surface 60 of the lock member extends underneath the seat portion 54 of the frame 24. Any attempted opening of the cover 12 will cause the lock member 20 to engage the frame 24 and prevent movement of the cover 12 to an open position. In one embodiment, shown in FIG. 8, there may be some play within the system that enables a slight movement of the cover 12, but ultimately the cover 12 is still prevented from being moved to the open position. In the alternative embodiment shown in FIG. 15, one or more of the lock members 20 may retain the cover 12 in a closed position as a result of the frictional interference between the lock member 20 and the inner surface 52' of the frame sidewall 42'.

The lock member 20 may be additionally secured in the lock position by the lock fastener 104 which, when inserted and threaded through the lock opening 102, engages the retention surface 60 of the lock member 20 to prevent movement of the lock member 20 even in the event that a removal tool 34 or another object is inserted into the release opening 96.

FIG. 6 shows the cover 12 in a closed position but the lock mechanism 18 in an unlocked position. In this state, a removal tool 34 has been inserted into the release opening 96, with the hook 114 engaged with the catch 64 of the lock member 20, and with the lock member 20 pulled along the slot 88 in an inward and upward direction, such that the post 94 is moved to the second end 92. In this position of the lock member 20, the interference surface 62 has been retracted such that it can clear the frame 24 without interference as a forced is placed on the cover 12, enabling the cover 12 to be pivoted to the open position. FIG. 7 shows the cover 12 having been lifted into an open position with the lock member 20 in the unlocked position. Such a position may be achieved by a user exerting a force on the handle 112 to pull the cover 12 to the open position, or via a different lift tool or method.

The metal parts described herein, including the cover 12 and the lock mechanism 18, can be machined, sand cast investment cast or otherwise formed using suitable techniques and apparatus. Sand casting is a process in which a pattern is made in the shape of the desired part. This pattern may be made out wood, plastic or metal. Simple designs can be made in a single piece or solid pattern. More complex designs are made in multiple parts, called split patterns. A split pattern has a top or upper section, called a cope, and a bottom or lower section called a drag. Both solid and split patterns can have cores inserted to complete the final part shape. Where the cope and drag separates is called the parting line. When making a pattern it is often best to taper the edges so that the pattern can be removed without breaking the mold.

The patterns are then packed in sand with a binder, which helps to harden the sand into a semi-permanent shape. Once the sand mold is cured, the pattern is removed leaving a hollow space in the sand in the shape of the desired part. The pattern is intentionally made larger than the cast part to allow for shrinkage during cooling. Sand cores can then be inserted in the mold to create holes and improve the casting's net shape. Simple patterns are normally open on top and melted metal is poured into them. Two piece molds are clamped together and melted metal is then poured into an opening, called a gate. If necessary, vent holes can be created to allow hot gases to escape during the pour. The pouring temperature of the metal should be a few hundred degrees higher than the melting point to assure good fluidity, thereby avoiding prematurely cooling, which will cause voids and porosity. When the metal cools, the sand mold is removed and the metal part is ready for secondary operations, such as machining and plating.

Investment casting is a casting process in which an expendable pattern is surrounded by an investment compound and then baked so that the investment is hardened to form a mold and the pattern material may be melted and run off. Investment castings can be used to produce intricate and metallurgical accurate castings with very tight tolerances. This method is used to mass produce parts with near net dimensions and a high quality "as cast finish" thereby producing a visually attractive finish and reducing machining cost.

In this process an expendable pattern is made, normally by injecting wax or plastic into a metal mold. The pattern is then coated, by either pouring or dipping, with a refractory slurry (watery paste of silica and a binder) that sets at ambient temperature to produce a mold or shell. After hardening, the mold is turned upside down and the expendable pattern (wax or plastic) is melted out of the mold. To complete this refractory mold, ceramic cores may be inserted. Investment castings can be made in almost any pourable metal or alloy.

III. Operation

As noted, the lock mechanism 18 may be constructed with the cover 12, or it may be provided as a retrofit system. In either case, the lock mechanism 18 is positioned on the cover 12 such that it is sufficiently close to the outer peripheral edge 16 to enable the lock member 20 to engage the frame 24 (or another fixed object) when the cover 12 is closed and prevent opening of the cover 12 without a release of the lock member 20. In the closed and locked position, shown in FIG. 5, the interference surface 62 of the lock member 20 is positioned underneath the seat 54 of the frame 24, such that the lock member 20 engages the frame 24 to prevent opening of the cover 12. The cover 12 may be additionally secured in the closed position by the threaded insertion of the threaded lock fastener 104 into the secondary lock opening 102.

When it is desired to release and open the cover 12, a user may engage the lock fastener 104 with a properly shaped and sized wrench or tool to remove the lock fastener 104. Removal (or sufficient loosening) of the lock fastener 104, as shown in FIG. 6, provides a gap between the lock fastener 104 and the retention surface 60 that enables movement of the lock member 20. After removal of the lock fastener 104, a user may utilize the removal tool 34 to move the lock member 20 to the unlocked position. This may be completed by inserting the removal tool 34 into the release opening 96 to engage the catch 64 on the lock member 20, and then pulling the removal tool 34 to slide the lock member 20 along the slot 88 to the unlocked position. More particularly, as the lock member 20 is pulled, the post 94 is moved from the first end 90 to the second end 92 of the slots 88, with the slots 88 controlling the path of travel. At the same time, the housing post 74 may travel within the generally open slot 72 in the lock member 20 to maintain the angular position of the lock member 20 as it travels. With the post 94 at the second end 92 of the slot 88, the lock member 20 is in the unlocked position and, as sown in FIG. 6 and FIG. 7, the cover 12 can be moved to an open position without interference between the lock member 20 and the frame 24. With the cover 12 in the open position, the user may access the exposed access opening 40 and enter the space below the frame 24.

Finally, closing and locking of the cover 12 may be completed by lowering (or sliding, in the case of the FIG. 16 embodiment) the cover 12 from the open position to the closed position wherein the cover 12 is seated on the frame seat 54 to cover the access opening 40. As the cover moves to the closed position, the lock member 20 may be manually retained in the unlocked position to prevent interference between the lock member 20 and the frame 24, or alternatively the lock member 20 may have a "slam latch" feature as noted above, to automatically be pushed by the frame 20 to the unlocked position as the cover 12 is closed. In any case, with the cover 12 in, or nearly in, a closed position, the angle of the slot 88 in an at least partially downward direction enables the lock member 20 to automatically fall from the unlocked position to the locked position, and the cover 12 is once again prevented from opening without use of the removal tool 34. The cover 12 may be further locked in place by reinserting or retightening the lock fastener 104 as a secondary form of security.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A manhole lock system comprising:

a cover having an upper surface, a lower surface and an outer peripheral edge; and a movable lock member adjacent to the lower surface, the lock member movable along a path between an unlocked position and a locked position, the path being angled such that the lock member travels outwardly toward the peripheral edge and away from the lower surface as the lock member travels along the path from the unlocked position to the locked position, the travel of the lock member caused by movement of the cover to a lowered position and without manipulation of the lock member by a user or a separate tool.

2. The manhole lock system of claim 1 wherein the lock member is connected to the lower surface by a lock housing, the lock member slidable within the lock housing.

3. The manhole lock system of claim 2 wherein one of the lock member and the lock housing define a slot, and the other of the lock member and the lock housing includes a pin extending into the slot, the pin sliding within the slot between the unlocked position and the locked position.

4. The manhole lock system of claim 3, wherein the cover defines a release opening extending from the upper surface to the lower surface, the release opening aligned with the lock housing to provide access to the lock member through the release opening, the lock member including a catch that can be accessed through the release opening to pull the lock member along the path from the locked position to the unlocked position.

5. A manhole lock system comprising:

a cover having an upper surface, a lower surface and an outer peripheral edge; and a movable lock member adjacent to the lower surface, the lock member movable along a path between an unlocked position and a locked position, the path being angled such that the lock member travels outwardly toward the peripheral edge and away from the lower surface as the lock member travels along the path from the unlocked position to the locked position, wherein the lock slides along the path from the unlocked position to the locked position under the force of gravity, wherein the lock member is connected to the lower surface by a lock housing, the lock member slidable within the lock housing, wherein one of the lock member and the lock housing define a slot, and the other of the lock member and the lock housing includes a pin extending into the slot, the pin sliding within the slot between the unlocked position and the locked position, wherein the cover defines a release opening extending from the upper surface to the lower surface, the release opening aligned with the lock housing to provide access to the lock member through the release opening, the lock member including a catch that can be accessed through the release opening to pull the lock member along the path from the locked position to the unlocked position, wherein the release opening and the housing are shaped to correspond to the shape of a removal tool, wherein the removal tool is capable of being inserted through the release opening to engage the catch and pull the lock member to the unlocked position.

6. The manhole lock system of claim 5 wherein the cover defines a lock opening extending through the cover from the upper surface to the lower surface, wherein the lock opening receives a fastener, the fastener engaging the lock member to prevent movement of the lock member.

7. The manhole lock system of claim 6 wherein the lock system includes a frame, the cover capable of being seated on the frame over an access opening to cover the access opening, and wherein the lock member engages the frame to prevent removal of the cover from the frame when the lock member is in the locked position, and wherein the lock member is clear of the frame to enable movement of the cover from covering the access opening when the lock member is in the unlocked position.

8. A manhole lock system comprising:

a frame defining an access opening;

a cover having a lower surface, an upper surface, and an outer peripheral edge, the cover movable between a closed position and an open position, wherein in the closed position, the lower surface engages the frame, the peripheral edge is adjacent to the frame, and the cover covers the access opening, and wherein in the open position, the cover permits access to the access opening, the cover defining a release opening extending through the cover; and a lock member positioned on the cover, the lock member connected to the cover such that the lock member is slidable along a path between an unlocked position and a locked position, wherein in the locked position the lock member is interfered by the frame and prevents movement of the cover from the closed position to the open position, and wherein in the unlocked position, the lock member clears the frame to enable moving the cover from the closed position to the open position, wherein the lock member automatically slides along the path from the unlocked position to the locked position due to the force of gravity and without manipulation of the lock member by the user.

9. The manhole lock system of claim 8 wherein the path extends at an angle with respect to the cover, such that the lock member moves outwardly and away from the lower surface of the cover as the lock member moves to the locked position.

10. A manhole lock system comprising:

a frame defining an access opening;

a cover having a lower surface, an upper surface, and an outer peripheral edge, the cover movable between a closed position and an open position, wherein in the closed position, the lower surface engages the frame, the peripheral edge is adjacent to the frame, and the cover covers the access opening, and wherein in the open position, the cover permits access to the access opening, the cover defining a release opening extending through the cover; and a lock member positioned on the cover, the lock member connected to the cover such that the lock member is slidable along a path between an unlocked position and a locked position, wherein in the locked position the lock member is interfered by the frame and prevents movement of the cover from the closed position to the open position, and wherein in the unlocked position, the lock member clears the frame to enable moving the cover from the closed position to the open position, wherein the path extends at an angle with respect to the cover, such that the lock member moves outwardly and away from the lower surface of the cover as the lock member moves to the locked position, wherein the lock member falls from the unlocked position to the locked position when the cover approaches the closed position.

11. The manhole lock system of claim 10 the lock member is connected to the lower surface by a lock housing, the lock member slidable within the lock housing.

12. The manhole lock system of claim 11 wherein one of the lock member and the lock housing define a slot, and the other of the lock member and the lock housing includes a pin extending into the slot, the pin sliding within the slot between the unlocked position and the locked position.

13. The manhole lock system of claim 12 wherein the lock member includes a catch, the catch accessible through the release opening to pull the lock member from the locked position to the unlocked position.

14. The manhole lock system of claim 13 wherein the release opening and the housing are shaped to correspond to the shape of a removal tool, wherein the removal tool is capable of being inserted through the release opening to engage the catch and pull the lock member to the unlocked position, and the removal tool and the release opening are shaped such that, while in the unlocked position, the removal tool can be further moved within the release opening to hold the lock member in the unlocked position.

15. The manhole lock system of claim 14 wherein the cover includes at least one of a hook and a hinge spaced from the lock member, the at least one of the hook and the hinge interfitting with a portion of the frame when the cover is in the closed position, such that the lock member and the at least one of the hook and the hinge can combine to hold the cover in the closed position.

16. A manhole lock system comprising:

a generally annular frame positioned over an access opening, the frame including a sidewall having an upper rim, a seat extending inwardly from the sidewall and spaced from the upper rim, and a first hinge portion defined in the sidewall;

a cover having an upper surface, a lower surface opposite the upper surface, an outer peripheral edge, and a second hinge portion, wherein the second hinge portion interfits with the first hinge portion such that the cover can pivot with respect to the frame between a closed position in which the lower surface of the cover is seated on the seat to cover the access opening, and an open position in which the access opening is exposed, the cover defining a release opening extending through the cover; and a lock mechanism for locking the cover in the closed position, the lock mechanism including a lock housing and a lock member, the lock housing connected to the lower surface of the cover adjacent to the release opening, the lock member being slidably mounted to the lock housing, wherein the lock member is slidable along a path between an unlocked position and a locked position, wherein in the locked position the lock member engages a portion of the frame when the cover is in the closed position to prevent the cover from moving to the open position, wherein in the unlocked position the lock member is retracted to enable movement of the cover to the open position, wherein the lock member automatically slides along the path from the unlocked position to the locked position due to the force of gravity and without manipulation of the lock member by the user.

17. A manhole lock system comprising:

a generally annular frame positioned over an access opening, the frame including a sidewall having an upper rim, a seat extending inwardly from the sidewall and spaced from the upper rim, and a first hinge portion defined in the sidewall;

a cover having an upper surface, a lower surface opposite the upper surface, an outer peripheral edge, and a second hinge portion, wherein the second hinge portion interfits with the first hinge portion such that the cover can pivot with respect to the frame between a closed position in which the lower surface of the cover is seated on the seat to cover the access opening, and an open position in which the access opening is exposed, the cover defining a release opening extending through the cover; and a lock mechanism for locking the cover in the closed position, the lock mechanism including a lock housing and a lock member, the lock housing connected to the lower surface of the cover adjacent to the release opening, the lock member being slidably mounted to the lock housing, wherein the lock member is slidable along a path between an unlocked position and a locked position, wherein in the locked position the lock member engages a portion of the frame when the cover is in the closed position to prevent the cover from moving to the open position, wherein in the unlocked position the lock member is retracted to enable movement of the cover to the open position, wherein the path of the lock member is angled such that the lock member slides outward and away from the cover as the lock member moves to the locked position, the lock member falling to the locked position upon the movement of the cover to the closed position.

18. The manhole lock system of claim 17 wherein the lock member is accessible through the release opening, wherein a release tool can be inserted through the release opening to pull the lock member from the locked position to the unlocked position.

19. The manhole lock system of claim 18, including a secondary lock opening defined in the cover, wherein a fastener can be inserted and retained in the secondary lock opening to prevent movement of the lock member.

* * * * *